US006740622B2

(12) United States Patent
Eto et al.

(10) Patent No.: US 6,740,622 B2
(45) Date of Patent: May 25, 2004

(54) THERMAL TRANSFER IMAGE-RECEIVING SHEET

(75) Inventors: Koji Eto, Shinjuku-Ku (JP); Satoshi Narita, Shinjuku-Ku (JP); Shinji Kometani, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 95 days.

(21) Appl. No.: 10/041,583

(22) Filed: Jan. 10, 2002

(65) Prior Publication Data

US 2002/0165093 A1 Nov. 7, 2002

(30) Foreign Application Priority Data

Jan. 15, 2001 (JP) ..... 2001-006522
May 14, 2001 (JP) ..... 2001-142953

(51) Int. Cl.[7] ..... B41M 5/00; B41M 5/035; B41M 5/38

(52) U.S. Cl. ..... 503/227; 428/32.11; 428/32.22; 428/32.25; 428/32.34; 428/32.39; 503/204

(58) Field of Search ..... 503/227, 204; 428/32.1, 32.22, 32.24, 32.11, 32.25, 32.34, 32.39

(56) References Cited

U.S. PATENT DOCUMENTS 4,642,247 A * 2/1987 Mouri et al. ..... 427/214
4,954,395 A * 9/1990 Hasegawa et al. ..... 428/318.4
5,027,131 A * 6/1991 Hasegawa et al. ..... 346/1.1
6,281,167 B1 * 8/2001 Takano et al. ..... 503/227

FOREIGN PATENT DOCUMENTS

EP 0 541 266 5/1993
EP 0 781 665 7/1997

* cited by examiner

*Primary Examiner*—B. Hamilton Hess
(74) *Attorney, Agent, or Firm*—Parkhurst & Wendel, L.L.P.

(57) ABSTRACT

A thermal transfer image-receiving sheet is provided which can realize composite recording on both sides of the thermal transfer image-receiving sheet by image formation respectively by means of a sublimation dye thermal transfer method and, in addition, by printing means different from the sublimation dye thermal transfer method. The thermal transfer image-receiving sheet comprises: a substrate; a first recording layer provided on one side of the substrate, an image being formable on the first recording layer by a sublimation dye thermal transfer method; and a second recording layer provided on the other side of the substrate and comprising a combination of two or more layers, the second recording layer permitting recording to be made by printing means other than the sublimation dye thermal transfer method, whereby composite recording can be made on both sides of the thermal transfer image-receiving sheet respectively by a plurality of types of image forming means.

11 Claims, 1 Drawing Sheet

THERMAL TRANSFER IMAGE-RECEIVING SHEET

BACKGROUND OF THE INVENTION

The present invention relates to a thermal transfer image-receiving sheet, and more particularly to a thermal transfer image-receiving sheet which can realize composite recording on both sides of the thermal transfer image-receiving sheet respectively by a plurality of types of image forming means.

In recent years, the adoption of a sublimation dye thermal transfer method could have enabled high-quality, high-definition images comparable to conventional silver salt photography to be simply realized. Printing of sublimation dye transfer images on postcards in a picture postcard manner followed by mailing or posting has also become widely adopted. In using the prints as postcards, printing of address, name and the like on the backside thereof is necessary. The backside of conventional image-receiving papers generally has no problem of writing with writing implements, but on the other hand, in printing by means of various printers (particularly ink jet printers), problems occur such as feathering of prints and slow drying of printed portions.

The present invention has been made with a view to solving the above problems of the prior art, and it is an object of the present invention to provide a thermal transfer image-receiving sheet which can realize composite recording on both sides of the thermal transfer image-receiving sheet by image formation respectively by means of a sublimation dye thermal transfer method and, in addition, by printing means different from the sublimation dye thermal transfer method.

It is another object of the present invention to provide a thermal transfer image-receiving sheet of which the backside has properties suitable particularly for printing of addresses and names by means of ink jet printers.

As described above, in recent years, the adoption of a sublimation dye thermal transfer method could have enabled high-quality, high-definition images comparable to conventional silver salt photography to be simply realized. Printing of sublimation dye transfer images on papers of postcard size followed by mailing or posting in a picture postcard manner has also become widely adopted. In using the prints as postcards, printing of address, name and the like on and the application of postage stamps to the backside thereof are necessary. Conventional methods for imparting writing quality to the backside of image-receiving sheets are described, for example, in Japanese Patent Laid-Open Nos. 239036/1994, 175052/1997, and 175048/1997, that is, include a method wherein a porous layer is formed using a hydrophilic filler on the backside of a thermal transfer image-receiving sheet, and a method wherein fine concaves and convexes are formed using a hard filler or a hard resin to render the backside suitable for writing. In general, however, the conventional methods pose no problem of writing with writing implements, but on the other hand, in printing by means of ink jet printers, problems occur such as feathering of prints and slow drying of printed portions. Further, when commercially available inks for ink jet printers are used, these inks are different from each other or one another in ink composition and solvent composition according to makers. For this reason, the level of feathering after printing varies depending upon inks, and, thus, it is difficult to provide even print quality.

In general, an ink-receptive layer should be very thickly coated on a substrate so that the ink composition ejected by ink jetting can be absorbed in the sheet. Therefore, in production equipment, such as gravure coaters or bar coaters which can be advantageously applied in the case of small coverage, it is difficult to provide any layer which enables ink jet printing. In addition, since fine concaves and convexes are formed to impart writing quality, for some level of concaves and convexes, the quality of thermal transfer image-receiving sheets is deteriorated.

In addition to writing quality, smaller friction against image-receiving face to realize stable paper feeding or delivery is required of the backside of thermal transfer image-receiving sheets. To this end, for example, Japanese Patent Laid-Open Nos. 101163/1995 and 223384/1995 disclose methods for reducing friction through the utilization of specific fillers or resins. These conventional methods can provide excellent paper feed and delivery properties. In these methods, however, it is difficult to simultaneously impart excellent paper feed properties and satisfactory writing quality and adhesion to postage stamps.

Accordingly, it is a further object of the present invention to provide a thermal transfer image-receiving sheet which, without causing a deterioration in quality attributable to concaves and convexes provided on the backside, can realize, at low coverage, good suitability for printing by means of ink jet printers and writing with various writing implements and, in addition, has satisfactory adhesion to postage stamps, has excellent carriability in printers, and can exhibit stable properties even after storage under high temperature conditions or under high temperature and high humidity conditions.

DISCLOSURE OF THE INVENTION

First Invention

According to a first invention, there is provided a thermal transfer image-receiving sheet comprising: a substrate; a first recording layer provided on one side of the substrate, an image being formable on the first recording layer by a sublimation dye thermal transfer method; and a second recording layer provided on the other side of the substrate and comprising a combination of two or more layers, said second recording layer permitting recording to be made by printing means other than the sublimation dye thermal transfer method, whereby composite recording can be made on both sides of the thermal transfer image-receiving sheet respectively by a plurality of types of image forming means.

According to a preferred embodiment of the present invention, the second recording layer comprises an absorption layer and a fixation layer provided in that order on the substrate to constitute a composite layer. The fixation layer in the second recording layer preferably comprises a polyvinyl acetal resin and a nylon filler.

The absorption layer in the second recording layer preferably comprises a polyvinyl butyral resin and a filler.

The second recording layer in the thermal transfer image-receiving sheet according to the present invention is particularly suitable for printing by ink jet recording and is further applied, for example, as a recording layer for thermal ink transfer or as a recording layer for electrophotography.

Second Invention

According to a second invention, there is provided a thermal transfer image-receiving sheet comprising a substrate sheet; a dye-receptive layer provided on at least one side of the substrate sheet; a hydrophilic porous layer (an absorption layer) provided on the substrate sheet in its side remote from the dye-receptive layer, said hydrophilic porous layer being composed mainly of a thermoplastic resin and hydrophilic porous particles; and a backside coating (a fixation layer) provided on the surface of the hydrophilic porous layer, said backside coating comprising a polyvinyl acetal resin, a silicone-modified acrylic resin, and nylon resin particles.

In the second invention, the content of the silicone-modified acrylic resin is preferably 5 to 35% by weight based on the total solid content of the backside coating.

Preferably, the nylon resin particles (nylon filler) have an average particle diameter of 5 to 20 $\mu$m and the weight ratio of the nylon resin particles to the resin in the backside coating is 0.25 to 2.0.

The thermoplastic resin in the hydrophilic porous layer is preferably a polyvinyl butyral resin or a polyvinyl acetal resin.

BEST MODE FOR CARRYING OUT THE INVENTION

First Invention

Figure 1:
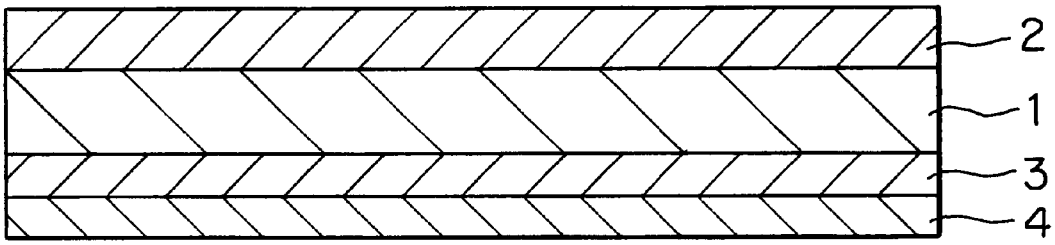
FIG. 1 is a cross-sectional view showing an embodiment of the thermal transfer image-receiving sheet according to the present invention.

The thermal transfer image-receiving sheet according to the first invention comprises: a substrate; a first recording layer provided on one side of the substrate, an image being formable on the first recording layer by a sublimation dye thermal transfer method; and a second recording layer provided on the other side of the substrate and comprising a combination of two or more layers, said second recording layer permitting recording to be made by printing means other than the sublimation dye thermal transfer method, whereby composite recording can be made on both sides of the thermal transfer image-receiving sheet respectively by a plurality of types of image forming means.

The second recording layer preferably comprises a combination of a plurality of layers, that is, an absorption layer and a fixation layer provided in that order on the substrate. In this construction, sharing of functions respectively by the plurality of layers combined in the thicknesswise direction can realize properties suitable particularly for printing by means of ink jet printers.

The substrate is not particularly limited, and conventional paper, synthetic paper, and other materials for thermal transfer image-receiving sheets may be extensively used according to applications.

The absorption layer provided on one side of the substrate comprises: a resin component having good adhesion to the surface of the substrate; and a relatively large amount of filler for rapidly absorbing and holding an ink composition for printing. Preferred resins for the absorption layer include polyvinyl butyrals, polyvinyl alcohols, cellulose acetate resins, acrylic resins, polystyrene resins, polyolefin resins, and polyamide resins.

Fillers, which may be added to the resin, include fine particles of organic polymers and inorganic fine particles. Fine particles of organic polymers include fine particles of nylon fillers, acrylic resins, styrene resins, silicone resins, and fluororesins. Preferred inorganic fine particles include silica, alumina, talc, calcium carbonate, barium sulfate, zinc oxide, and titanium oxide. The average particle diameter of the filler is preferably 0.05 to 30 $\mu$m, more preferably 0.1 to 10 $\mu$m, from the viewpoint of rapidly absorbing and holding ink.

The weight ratio of the filler to the resin in the absorption layer is preferably 0.1 to 3.0, more preferably 0.2 to 2.5, particularly preferably 1.5 to 2.0, from the viewpoints of realizing better ink absorption and holding properties.

The absorption layer is preferably formed by coating the above composition for an absorption layer onto the substrate at a coverage of about 0.5 to 5.0 g/m$^2$, more preferably 1.0 to 3.0 g/m$^2$.

The fixation layer provided on the absorption layer functions to improve the migration of the printing ink composition to the absorption layer and is important for improving the printing properties through a combination of the absorption layer with the fixation layer. Resins for fixation preferable for developing this function include: water-soluble resins, such as polyvinyl acetal, polyvinyl alcohol, polyvinyl pyrrolidone, polyvinyl butyral, cellulose acetate, nitrocellulose, hydroxyethylcellulose, hydroxypropylcellulose, methylcellulose, starch, and gelatin; water-soluble acrylic resins; water-soluble urethane resins; and mixtures of these resins or copolymers of monomers constituting the above resins.

Fillers, which may be added to the above resin, include fine particles of organic polymers and inorganic fine particles. Preferred inorganic fine particles include silica, alumina, talc, calcium carbonate, barium sulfate, zinc oxide, and titanium oxide. The average particle diameter of the filler is preferably 5 to 20 $\mu$m, more preferably 5 to 15 $\mu$m, from the viewpoint of realizing fast drying properties of ink (that is, rapid penetration of ink into the absorption layer). Specifically, when the average particle diameter of the filler is less than 5 $\mu$m, the fast drying properties are poor. On the other hand, an average particle diameter exceeding 20 $\mu$m unfavorably increases surface roughness. A combination of polyvinyl acetal resin with a nylon filler is most preferred for the fixation layer.

The weight ratio of the filler to the resin in the fixation layer is preferably in the range of 0.25 to 2.0, more preferably in the range of 0.8 to 1.0, from the viewpoint of realizing better fast drying properties and penetration of ink. When the weight ratio is less than 0.25, the fast drying properties are poor, while, when the weight ratio exceeds 2.0, disadvantageously, the layer strength is lowered and the fixation of ink is likely to lower.

The fixation layer is preferably formed by coating the above composition for a fixation layer onto the substrate at a coverage of about 0.4 to 10 g/m$^2$, more preferably about 0.7 to 2.0 g/m$^2$.

In particular, when commercially available inks for ink jet printers are used, these inks are different from each other or one another in dye composition and solvent composition of ink according to makers and, thus, the level of feathering after printing varies depending upon inks, making it difficult to provide even print quality. Accordingly, the incorporation of a surfactant into the fixation layer is preferred for regulating the penetration of ink and, in addition, more effectively preventing feathering. Surfactants usable to this end include conventional cationic surfactants and nonionic surfactants. Among them, fluorosurfactants, for example, acrylate copolymers or acrylic oligomers wherein nonionic perfluoroalkyl groups have been polymerized in a pendant form, are particularly preferred. The amount of the surfactant added is suitably about 0.5 to 10% by weight, preferably 1 to 5% by weight, based on the fixation layer (on a solid basis). When the amount of the surfactant added is less than 0.5% by weight, the effect of improving the prevention of feathering is poor, while an amount of the surfactant added of more than 10% by weight is disadvantage in terms of production cost.

The second recording layer comprising a combination of the absorption layer with the fixation layer is particularly suitable for recording by printing by means of ink jet printers and further can realize, as a recording layer for thermal ink transfer or as a recording layer for electrophotography, better printing properties than the conventional recording layer.

In the thermal transfer image-receiving sheet according to the present invention, the first recording layer (dye-receptive layer), on which an image can be formed by the sublimation dye thermal transfer method, is not particularly limited. However, preferred examples of materials for constituting the dye-receptive layer are as follows.

(i) Resins having ester bond including polyester resins, polyacrylic ester resins, polycarbonate resins, polyvinyl acetate resins, and styrene acrylate resins.

(ii) Resins having urethane bond including polyurethane resins.

(iii) Resins having amide bond.

(iv) Resins having urea bond including urea resins.

(v) Other resins having highly polar bond including polycaprolactone resins, styrene-maleic anhydride resins, polyvinyl chloride resins, and polyacrylonitrile resins.

In addition to the above synthetic resins, for example, mixtures of these resins or copolymers of monomers constituting these resins may also be used. At the time of transfer, the dye-receptive layer is heat pressed against a thermal transfer sheet, for example, by means of a thermal head and thus is likely to stick to the thermal transfer sheet. To prevent the sticking, in forming the dye-receptive layer, a release agent permeable to dyes is generally incorporated into the above resin. Release agents usable herein include solid waxes, fluoro or phosphoric ester surfactants, and silicone oils. In the silicone oils, although oil-type silicone oils may be used, reaction-curable silicone oils, for example, combinations of amino-modified silicones with epoxy-modified silicones, are preferred.

When the release agent is solid wax, the release agent is added, to the resin, in an amount of 0.5 to 50% by weight, preferably 0.5 to 10% by weight, based on the weight of the resin. On the other hand, the reaction-curable silicone oil as the release agent is free from stickiness and thus may be added in a large amount, that is, may be used in an amount of 0.5 to 30% by weight based on the weight of the resin. In both the cases, when the amount of the release agent added is smaller than the above-defined range, the release effect is unsatisfactory, while, when the amount of the release agent added is larger than the above-defined range, the receptivity to dyes is lowered, resulting in adverse effect including that satisfactory record density cannot be provided.

Methods for imparting releasability to the dye-receptive layer include, in addition to the above method wherein a release agent is incorporated into the dye-receptive layer, a method wherein a release layer is separately stacked on the dye-receptive layer. The releasability may be imparted by any of the above methods. If necessary, inorganic fillers, such as finely divided silica and titanium oxide, antioxidants, ultraviolet absorbers and the like may be incorporated into the dye-receptive layer.

The dye-receptive layer may be formed on a substrate sheet, for example, by coating a solution of these materials in an organic solvent or a dispersion of these materials in an organic solvent or water by gravure printing, screen printing, reverse roll coating using a gravure plate, die coating or the like and then drying the coating. For some materials, the dye-receptive layer may be formed by melt extrusion coating without the use of any organic solvent and water. Although the thickness of the dye-receptive layer formed by the above method may be any desired one, the thickness is generally 1 to 50 $\mu$m.

An intermediate layer having a single-layer or multi-layer structure may be provided between the dye-receptive layer and the substrate sheet. The intermediate layer refers to all of layers provided between the receptive layer and the substrate sheet, for example, an adhesive layer (a primer layer), a white-imparting layer, a barrier layer, an UV (ultraviolet) absorbing layer, a foam layer, and an antistatic layer. If necessary, layers other than conventional layers used as the intermediate layer may also be used as the intermediate layer. The intermediate layer or the backside layer may be the same as that in the second invention which will be described later.

Second Invention

The second invention will be described in detail with reference to preferred embodiments.

Figure 2:
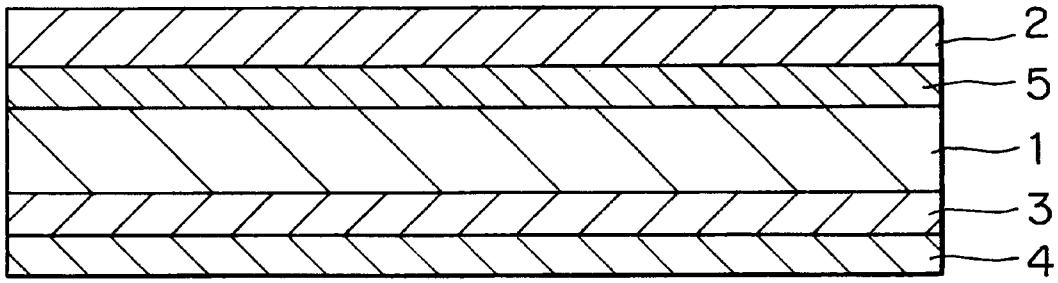
FIG. 2 is a cross-sectional view showing another embodiment of the thermal transfer image-receiving sheet according to the present invention.

As shown in FIG. 1, in the thermal transfer image-receiving sheet according to the second invention, a dye-receptive layer 2 is provided on at least one side of a substrate sheet 1, and a hydrophilic porous layer (an absorption layer) 3 composed mainly of a thermoplastic resin and hydrophilic porous particles is provided on the substrate sheet 1 in its side remote from the dye-receptive layer 2, and a backside coating (a fixation layer) 4 comprising a polyvinyl acetal resin, a silicone-modified acrylic resin, and nylon resin particles is further provided on the surface of the hydrophilic porous layer 3. As shown in FIG. 2, an intermediate layer 5 may be provided between the dye-receptive layer 2 and the substrate sheet 1.

Next, elements constituting the thermal transfer image-receiving sheet according to the second invention will be described.

Substrate Sheet

In the second invention, materials usable for the substrate sheet 1 include papers including various papers in a simple form and converted papers, and examples thereof include wood-free papers, coated papers, art papers, cast coated papers, paperboards, papers impregnated, for example, with resin emulsions or synthetic rubber latexes, and papers with a synthetic resin being internally added thereto. Further, laminate papers comprising various plastic films laminated onto these papers.

Synthetic papers usable herein include polyolefin synthetic papers and polystyrene synthetic papers. Plastic films include polyolefin resin films, polyester resin films, and polystyrene films. The form of these plastic films is not particularly limited. Specifically, examples of the form of the plastic films include, in addition to transparent films, white opaque films formed after the incorporation of white pigments or fillers, and foamed films.

When a plastic film is used as the substrate sheet, if necessary, a plasticizer or the like may be added to the film from the viewpoint of regulating the rigidity of the film. The plastic film may be used either as such or, as described above, a laminate of the plastic film and other materials. In forming an intermediate layer or a dye-receptive layer on the above substrate sheet, if necessary, the substrate sheet may be subjected, for example, to corona discharge treatment or plasma discharge treatment. The thickness of the substrate sheet is generally in the range of about 1 to 400 $\mu$m, preferably in the range of about 100 to 300 $\mu$m.

Dye-Receptive Layer

In the thermal transfer image-receiving sheet according to the second invention, the dye-receptive layer 2 may be the same as that in the first invention and may be formed of any conventional material used in the sublimation dye thermal transfer method without particular limitation. For example, the following materials are usable.

(i) Resins having ester bond including polyester resins, polyacrylic ester resins, polycarbonate resins, polyvinyl acetate resins, and styrene acrylate resins.

(ii) Resins having urethane bond including polyurethane resins.

(iii) Resins having amide bond including polyamide resins.

(iv) Resins having urea bond including urea resins.

(v) Other resins having highly polar bond including polycaprolactone resins, styrene-maleic anhydride resins, polyvinyl chloride resins, and polyacrylonitrile resins.

In addition to the above synthetic resins, for example, mixtures of these resins or copolymers of monomers constituting these resins may also be used.

At the time of transfer, the dye-receptive layer is heat pressed against a thermal transfer image-receiving sheet, for example, by means of a thermal head and thus is likely to stick to the thermal transfer image-receiving sheet. To prevent the sticking, in forming the dye-receptive layer, a release agent permeable to dyes is generally incorporated into the above resin. Release agents usable herein include solid waxes, fluoro or phosphoric ester surfactants, and silicone oils. In the silicone oils, although oil-type silicone oils may be used, reaction-curable silicone oils, for example, combinations of amino-modified silicones with epoxy-modified silicones, are preferred.

When the release agent is solid wax, the release agent is added, to the resin, in an amount of 0.5 to 50% by weight, preferably 0.5 to 10% by weight, based on the weight of the resin. On the other hand, the reaction-curable silicone oil as the release agent is free from stickiness and thus may be used in a large amount, that is, may be added in an amount of 0.5 to 30% by weight. In both the cases, when the amount of the release agent added is smaller than the above-defined range, the release effect is unsatisfactory, while, when the amount of the release agent added is larger than the above-defined range, the receptivity to dyes is lowered, resulting in adverse effect including that satisfactory record density cannot be provided.

Methods for imparting releasability to the dye-receptive layer include, in addition to the above method wherein a release agent is incorporated into the dye-receptive layer, a method may also be used wherein a release layer is separately stacked on the dye-receptive layer. The releasability may be imparted by any of the above methods. If necessary, inorganic fillers, such as finely divided silica and titanium oxide, antioxidants, ultraviolet absorbers and the like may be incorporated into the dye-receptive layer.

The dye-receptive layer may be formed on a substrate sheet, for example, by coating a solution of these materials in an organic solvent or a dispersion of these materials in an organic solvent or water by gravure printing, screen printing, reverse roll coating using a gravure plate, die coating or the like and then drying the coating. For some materials, the dye-receptive layer may be formed by melt extrusion coating without the use of any organic solvent and water. Although the thickness of the dye-receptive layer formed by the above method may be any desired one, the thickness is generally 1 to 50 $\mu$m.

Intermediate Layer

Any conventional intermediate layer may be provided between the receptive layer and the substrate sheet, for example, from the viewpoints of imparting the adhesion between the receptive layer and the substrate sheet and preventing curling. Binder resins usable in the intermediate layer include polyurethane resins, polycarbonate resins, polyamide resins, acrylic resins, polystyrene resins, polysulfone resins, polyvinyl chloride resins, polyvinyl acetate resins, vinyl chloride-vinyl acetate copolymer resins, polyvinyl acetal resins, polyvinyl butyral resins, polyvinyl alcohol resins, epoxy resins, cellulosic resins, ethylene-vinyl acetate copolymer resins, polyethylene resins, and polypropylene resins. Isocyanate-cured products of resins having active hydrogen among these resins may also be used as the intermediate layer.

Fillers, such as titanium oxide, magnesium oxide, and calcium carbonate, are preferably added to impart whiteness or opaqueness to the thermal transfer image-receiving sheet. Further, for example, stilbene compounds, benzimidazole compounds, and benzoxazole compounds may be added as brightening agents to enhance whiteness; hindered amine compounds, hindered phenol compounds, benzotriazole compounds, and benzophenone compounds may be added as ultraviolet absorbers or antioxidants to enhance the light-fastness of prints; or cationic acrylic resins, various conductive fillers and the like may be added to impart antistatic properties.

Backside Layer

The backside layer has a two-layer structure of a hydrophilic porous layer 3 and a backside coating 4. The hydrophilic porous layer 3 mainly has the following three functions. The first function is to impart good adhesion between the substrate sheet and the backside coating 4, the second function is to impart the absorption of ink of various writing implements and ink jet printers, and the third function is to impart a certain level of hardness and a certain level of concaves and convexes necessary for writing with pencils or the like.

The backside coating 4 mainly has the following three functions. The first function is to prevent feathering of prints produced by ink jet printers and to fix inks, the second function is to impart adhesion to postage stamps, and the third function is to impart a high level of slipperiness.

The hydrophilic porous layer 3 comprises a thermoplastic resin component having good adhesion to the surface of the substrate and hydrophilic porous particles for rapidly absorbing ink of various writing implements and ink compositions for ink jet printers and for imparting hardness and concaves and convexes.

Preferred thermoplastic resin component are resins useful as binders, and examples thereof include: resins, such as polyvinyl acetal, polyvinyl alcohol, polyvinyl pyrrolidone, polyvinyl butyral, cellulose acetate, nitrocellulose, hydroxyethylcellulose, hydroxypropylcellulose, methylcellulose, starch, and gelatin; water-soluble acrylic resins; water-soluble urethane resins; and mixtures of these resins or copolymers of monomers constituting the above resins. When a combination of materials is taken into consideration, butyral resin or acetal resin among these resins is preferred from the viewpoint of high adhesion to the backside coating.

Hydrophilic porous particles, which may be added to the thermoplastic resin, include silica, alumina, talc, calcium carbonate, barium carbonate, zinc oxide, and titanium oxide. Among them, silica particles having high absorption are preferred. The average particle diameter of the particles is preferably in the range of 0.05 to 30 $\mu$m, more preferably in the range of 0.1 to 10 $\mu$m. When the average particle diameter is less than 0.05 $\mu$m, the level of concaves and convexes necessary for writing with pencils or the like cannot be maintained. On the other hand, when the average particle diameter exceeds 30 μm, the hand feeling of the surface is deteriorated and, in addition, the coating strength is lowered, leading to a fear of particles being separated.

In order to realize better ink absorption and holding function, the weight ratio of the particles to the resin in the hydrophilic porous layer is preferably 0.25 to 3.0, particularly preferably 1.5 to 2.0.

The hydrophilic porous layer is preferably formed by adding optional additives to the above-described composition, dissolving or dispersing the mixture in a suitable organic solvent or water to prepare a solution or a dispersion, coating the solution or the dispersion by forming means, for example, gravure printing, screen printing, or reverse coating using a gravure plate, and drying the coating. In this case, the hydrophilic porous layer is preferably formed on the substrate sheet 1 at a coverage of about 0.5 to 20 g/m$^2$, more preferably about 1.0 to 10 g/m$^2$.

As described above, the backside coating comprises a polyvinyl acetal resin, a silicone-modified acrylic resin, and nylon resin particles. The polyvinyl acetal resin functions to fix ink compositions for ink jet printers and further functions as a binder. The silicone-modified acrylic resin functions to prevent feathering of ink of various writing implements and ink compositions for ink jet printers and further functions to develop slipperiness. The nylon resin particles function to allow ink compositions to rapidly migrate to the hydrophilic porous layer and further function to develop slipperiness.

The degree of acetalization of the polyvinyl acetal resin is generally in the range of 2 to 40% by mole, preferably in the range of 3 to 30% by mole, more preferably in the range of 5 to 20% by mole. When the degree of acetalization is below the above-defined range, the fixation of ink is sometimes deteriorated.

A graft or block copolymer of acrylic resin with polyorganosiloxane may be utilized as the silicone-modified acrylic resin. In the case of an aqueous system, an aqueous solution or an emulsion dispersion-type aqueous solution of the silicone-modified acrylic resin may be utilized. The silicone-modified acrylic resin in its acryl main chain having high affinity for the thermoplastic resin of the porous layer maintains the adhesion to the substrate sheet, while the silicone-modified acrylic resin in its silicone portion having low affinity for the resin in the porous layer is present on the surface of the backside coating remote from the substrate sheet, that is, on the surface of the backside of the thermal transfer image-receiving sheet, and thus functions to conduct the modification of the surface including imparting of water repellency. By virtue of a certain level of water repellency, the penetration of ink of writing implements and ink jet recording ink, which are highly likely to cause feathering, can be regulated to prevent feathering. Further, the presence of the silicone portion on the surface of the backside of the thermal transfer image-receiving sheet can improve slipperiness of the thermal transfer image-receiving sheet at the time of lamination onto the image-receiving face and thus can provide stable carriability of the image-receiving sheet.

In the case of the emulsion dispersion-type aqueous solution, the diameter of emulsion particles is preferably 40 to 150 nm, more preferably 60 to 100 nm. When the diameter of the emulsion particles is less than 40 nm, it is difficult to prepare such emulsion particles and the cost is high. On the other hand, when the diameter of the emulsion particles exceeds 150 nm, feathering of ink of various writing implements is likely to occur.

The content of the silicone-modified acrylic resin is preferably 5 to 35% by weight based on the total solid content of the backside coating. When the silicone-modified acrylic resin content is less than 5% by weight, the effect of preventing the feathering of ink cannot be attained leading to a deterioration in writing quality, while, when the silicone-modified acrylic resin content exceeds 35% by weight, the fixation of ink is deteriorated.

Preferably, the nylon resin particles have a molecular weight of 100000 to 900000, are spherical, and have an average particle diameter of 5 to 20 μm. Nylon resin particles having a molecular weight of 100000 to 500000 and an average particle diameter of 5 to 20 μm are more preferred. Regarding the type of nylon resin particles, nylon 12 fillers are more preferred than nylon 6 or nylon 66 fillers from the viewpoints of excellent waterfastness and no change in properties attributable to absorption.

When the average particle diameter of the filler is less than 5 μm, the filler is hidden by the backside coating and, thus, the fast drying properties of prints produced by ink jet printing are deteriorated and, at the same time, the slipperiness is lost. On the other hand, when the average particle diameter of the filler exceeds 20 μm, the level of protrusion of the filler from the backside layer is so large that the hand feeling is deteriorated resulting in deteriorated quality and, at the same time, feathering occurs at the time of writing with various writing implements leading to a deterioration in writing quality.

The weight ratio of the nylon particles to the resin in the backside coating is suitably in the range of 0.25 to 2.0, preferably in the range of 0.5 to 1.0. When the weight ratio is less than 0.25, the fast drying properties of prints produced by ink jet printing are deteriorated leading to a deterioration in slipperiness. On the other hand, a weight ratio exceeding 2.0 results in lowered coating strength, lowers the fixation of ink at the time of ink jet printing, and increases the level of feathering of ink at the time of writing with various writing implements.

The backside coating is preferably formed by adding optional additives to the above-described composition, dissolving or dispersing the mixture in a suitable organic solvent or water to prepare a solution or a dispersion, coating the solution or the dispersion by forming means, for example, gravure printing, screen printing, or reverse coating using a gravure plate, and drying the coating. In this case, the backside coating is formed on the porous layer at a coverage of about 0.3 to 20 g/m$^2$, preferably 0.5 to 5.0 g/m$^2$.

EXAMPLES

The following examples further illustrate the present invention, but are not intended to limit it. In the following examples, "parts" and "%" are by weight.

Example A1

The following composition for an absorption layer was coated on a substrate sheet at a coverage of 1.5 g/m$^2$ on a dry basis, and the coating was dried to form an absorption layer. The following composition for a fixation layer was then coated onto the absorption layer at a coverage of 0.7 g/m$^2$ on a dry basis, and the coating was dried to form the backside of an image-receiving paper of Example A1.

| Composition for absorption layer | |
|---|---|
| Polyvinyl butyral resin (#3000-I, manufactured by Denki Kagaku Kogyo K.K.) | 100 parts |
| Microsilica (Sylysia 730, manufactured by Fuji Sylysia Chemical Ltd.) | 150 parts |
| Toluene/IPA = 1/1 | 200 parts |
| Composition for fixation layer | |
| Polyvinyl acetal resin (KX-5, manufactured by Sekisui Chemical Co., Ltd.) | 100 parts |
| Nylon filler (MW 330, manufactured by Shinto Paint Co., Ltd.) | 100 parts |
| Fluorosurfactant (EFTOP EF 802, manufactured by JEMCO) | 2 parts |
| Water/IPA = 1/1 | 2000 parts |

Example A2

The backside of an image-receiving paper of Example A2 was formed in the same manner as in Example A1, except that, in the formation of the absorption layer, the following composition for an absorption layer was coated on the substrate sheet at a coverage of 1.5 g/m$^2$ on a dry basis and the coating was dried.

| Composition for absorption layer | |
|---|---|
| Polyvinyl butyral resin (#3000-I, manufactured by Denki Kagaku Kogyo K.K.) | 100 parts |
| Microsilica (Sylysia 310, manufactured by Fuji Sylysia Chemical Ltd.) | 300 parts |
| Toluene/IPA = 1/1 | 200 parts |

Example A3

The backside of an image-receiving paper of Example A3 was formed in the same manner as in Example A1, except that only the composition for the ink fixation layer was changed to the following composition.

| Composition for fixation layer | |
|---|---|
| Polyvinyl acetal resin (KX-5, manufactured by Sekisui Chemical Co., Ltd.) | 100 parts |
| Nylon filler (MW 330, manufactured by Shinto Paint Co., Ltd.) | 100 parts |
| Fluorosurfactant (Megafac F 470, manufactured by Dainippon Ink and Chemicals, Inc.) | 2 parts |
| Water/IPA = 1/1 | 2000 parts |

Example A4

The backside of an image-receiving paper of Example A4 was formed in the same manner as in Example A1, except that only the composition for the ink fixation layer was changed to the following composition.

| Composition for fixation layer | |
|---|---|
| Polyvinyl acetal resin (KX-5, manufactured by Sekisui Chemical Co., Ltd.) | 100 parts |
| Nylon filler (MW 330, manufactured by Shinto Paint Co., Ltd.) | 100 parts |
| Fluorosurfactant (EFTOP EF 802, manufactured by JEMCO) | 0.6 parts |
| Water/IPA = 1/1 | 2000 parts |

Example A5

The backside of an image-receiving paper of Example A5 was formed in the same manner as in Example A1, except that only the composition for the ink fixation layer was changed to the following composition.

| Composition for fixation layer | |
|---|---|
| Polyvinyl acetal resin (KX-5, manufactured by Sekisui Chemical Co., Ltd.) | 100 parts |
| Nylon filler (MW 330, manufactured by Shinto Paint Co., Ltd.) | 100 parts |
| Water/IPA = 1/1 | 2000 parts |

Comparative Example A1

The backside of an image-receiving paper of Comparative Example A1 was formed in the same manner as in Example A1, except that only the absorption layer was formed by coating and no fixation layer was formed.

Comparative Example A2

The backside of an image-receiving paper of Comparative Example A2 was formed in the same manner as in Example A1, except that the fixation layer was formed by coating at a coverage of 0.3 g/m$^2$ on a dry basis.

Comparative Example A3

The backside of an image-receiving paper of Comparative Example A3 was formed in the same manner as in Example A1, except that only the composition for the ink fixation layer was changed to the following composition.

| Composition for fixation layer | |
|---|---|
| Polyvinyl acetal resin (KX-5, manufactured by Sekisui Chemical Co., Ltd.) | 100 parts |
| Water/IPA = 1/1 | 2000 parts |

Comparative Example A4

The backside of an image-receiving paper of Comparative Example A4 was formed in the same manner as in Example A1, except that only the composition for the ink fixation layer was changed to the following composition.

| Composition for fixation layer | |
|---|---|
| Polyvinyl acetal resin (KX-5, manufactured by Sekisui Chemical Co., Ltd.) | 100 parts |
| Nylon filler (Orgasol 2002 ES-3, manufactured by Nihon Rilsan K.K.) | 100 parts |
| Water/IPA = 1/1 | 2000 parts |

Comparative Example A5

The backside of an image-receiving paper of Comparative Example A5 was formed in the same manner as in Example A1, except that only the composition for the ink fixation layer was changed to the following composition.

| Composition for fixation layer | |
|---|---|
| Polyvinyl acetal resin (KX-5, manufactured by Sekisui Chemical Co., Ltd.) | 100 parts |
| Nylon filler (MW 330, manufactured by Shinto Paint Co., Ltd.) | 200 parts |
| Water/IPA = 1/1 | 2000 parts |

The average particle diameter (μm) of the filler contained in the backside layer in the examples and the comparative examples was as follows.

Sylysia 730: 3.0 μm

Sylysia 310: 1.4 μm

MW 330: 7.5 μm

Orgasol 2002 ES-3: 30 μm

Printing Test

A printing test was carried out using various printing methods according to the following evaluation methods.

A. Printing by Ink Jet Printers

A printing test was carried out using ink jet printers on the backside of image-receiving papers prepared in the examples and the comparative examples to evaluate the performance of the image-receiving papers. The printers used were "PM 770 C" manufactured by Seiko Epson Corporation and "BJF 850" manufactured by Canon Inc. In the test, genuine inks designated by the makers were used.

(1) Feathering of Ink

Feathering in desired printed characters was visually evaluated according to the following criteria.

◎: No feathering

○: Slight feathering

Δ: Some feathering

×: Significant feathering

Evaluation results of ○ or better are preferred from the practical point of view.

(2) Fixation of Ink

The time necessary for the ink fixation layer to be held without being separated and the ink no longer to be transferred, when the print was lightly touched by the hand after printing, was measured from immediately after printing to evaluate the fixation of ink.

◎: No ink transfer was observed within 30 sec after printing.

○: No ink transfer was observed within 60 sec after printing.

Δ: No ink transfer was observed within 120 sec after printing.

×: Ink fixation layer was separated.

B. Thermal Ink-Transfer Method

A printing test was carried out by a thermal ink-transfer method to evaluate the performance of the image-receiving papers. The printer used was a model MFC 8300 J printer manufactured by Brother. Image-receiving paper, on which printing could be successfully carried out, was evaluated as ○, while image-receiving paper, on which printing could not be carried out, was evaluated as ×.

C. Electrophotography

A printing test was carried out by electrophotography to evaluate the performance of the image-receiving papers. The printer used was Docu Centre 350 manufactured by Fuji Xerox Co., Ltd. Image-receiving paper, on which printing could be successfully carried out, was evaluated as ○, while image-receiving paper, on which printing could not be carried out, was evaluated as ×.

Surface Harshness

The level of concaves and convexes of the backside was evaluated by a sensory test with the hand.

◎: The backside was free from concaves and convexes, and the quality was felt high.

○: Concaves and convexes were slightly observed on a level such that had no influence on texture.

Δ: Concaves and convexes were somewhat observed, and the level of the texture was felt low.

×: Concaves and convexes were significantly observed, and the texture was deteriorated.

TABLE A1

| | Evaluation of recording by various printing methods | | | | | | |
|---|---|---|---|---|---|---|---|
| | Ink jet | | | | | | |
| | PM 770 C | | BJF 850 | | Thermal ink | Electrophotography | |
| | Feathering | Fixation of ink | Feathering | Fixation of ink | transfer Transferability | Print quality | Surface harshness |
| Ex. A1 | ◎ | ◎ | ◎ | ◎ | ○ | ○ | ◎ |
| Ex. A2 | ◎ | ◎ | ◎ | ◎ | ○ | ○ | ◎ |
| Ex. A3 | ◎ | ◎ | ◎ | ◎ | ○ | ○ | ◎ |
| Ex. A4 | ◎ | ◎ | ○ | ◎ | ○ | ○ | ○ |
| Ex. A5 | ○ | ◎ | ○ | ◎ | ○ | ○ | ○ |
| Comp. Ex. A1 | X | ◎ | X | ◎ | ○ | ○ | ○ |
| Comp. Ex. A2 | X | Δ | X | Δ | ○ | ○ | ○ |
| Comp. Ex. A3 | ◎ | X | ◎ | X | ○ | ○ | ○ |

TABLE A1-continued

| | Evaluation of recording by various printing methods | | | | | | |
|---|---|---|---|---|---|---|---|
| | Ink jet | | | | | | |
| | PM 770 C | | BJF 850 | | Thermal ink | Electrophotography | |
| | Feathering | Fixation of ink | Feathering | Fixation of ink | transfer Transferability | Print quality | Surface harshness |
| Comp. Ex. A4 | Δ | ◎ | Δ | ◎ | ○ | ○ | X |
| Comp. Ex. A5 | ○ | Δ | ○ | Δ | ○ | ○ | ○ |

As is apparent from the results of the above examples, for the thermal transfer image-receiving sheets for composite recording according to the present invention, by virtue of the above construction, composite recording is possible on both sides of the recording sheet by image formation according to a sublimation dye thermal transfer method and, in addition, by image formation using printing means different from the sublimation dye thermal transfer method. The present invention provides thermal transfer image-receiving sheets having properties suitable particularly for printing of an address on the backside of the image-receiving sheets by means of an ink jet printer.

Example B1

The following composition for a hydrophilic porous layer was coated at a coverage of 1.5 g/m$^2$ on a dry basis onto a substrate sheet (150 μm-thick synthetic paper; FPG #150, manufactured by YUPO Corporation), and the coating was dried to form a hydrophilic porous layer. The following composition for a backside coating was then coated at a coverage of 0.7 g/m$^2$ on a dry basis onto the hydrophilic porous layer, and the coating was then dried to form a backside coating of the thermal transfer image-receiving sheet. Thus, a thermal transfer image-receiving sheet of Example B1 was prepared.

| Composition for hydrophilic porous layer | |
|---|---|
| Polyvinyl butyral resin (#3001-1, manufactured by Denki Kagaku Kogyo K.K.) | 100 parts |
| Microsilica (average particle diameter 3.0 μm) (Sylysia 730, manufactured by Fuji Sylysia Chemical Ltd.) | 100 parts |
| Microsilica (average particle diameter 1.4 μm) (Sylysia 310, manufactured by Fuji Sylysia Chemical Ltd.) | 80 parts |
| Water/isopropyl alcohol = 1/1 | 200 parts |
| Composition for backside coating | |
| Polyvinyl acetal resin (KX-5, manufactured by Sekisui Chemical Co., Ltd.) | 100 parts |
| Nylon filler (average particle diameter 7.5 μm) (MW 330, manufactured by Shinto Paint Co., Ltd.) | 100 parts |
| Silicone-modified acrylic resin (manufactured by JSR) | 11 parts |
| Water/isopropyl alcohol = 1/1 | 2000 parts |

The thermal transfer image-receiving sheet of Example B1 prepared above was evaluated by the following methods.

Evaluation Methods

1. Suitability for Printing by Means of Ink Jet Printers

Printing was carried out on the backside of the thermal transfer image-receiving sheet by means of ink jet printers, and the prints were then evaluated for performance of the thermal transfer image-receiving sheet. The printers used were PM 770 C manufactured by Seiko Epson Corporation and BJF 850 manufactured by Canon Inc. In this test, genuine inks designated by the makers were used.

(1) Feathering of Ink

Feathering in desired printed characters was visually evaluated according to the following criteria.

○: No feathering

Δ: Some feathering

×: Significant feathering (2) Fixation of Ink

After printing on the backside of the thermal transfer image-receiving sheet, white paper was put on the print. In this state, the white paper was pressed against the print at a pressure of 34 gf/cm$^2$ for 5 sec, and the time necessary for the ink no longer to be transferred onto the white paper was measured to evaluate the fixation of ink.

○: No ink transfer was observed within 120 sec after printing.

Δ: No ink transfer was observed within 300 sec after printing.

Δ: Ink transfer was observed even 300 sec after printing.

2. Writing Quality

Characters were written on the backside of the thermal transfer image-receiving sheet with an oil-base pen, a water-base pen, a pencil, and a ballpoint pen as representative writing implements, and the writing quality was evaluated according to the following criteria.

○: Characters could be smoothly written at a satisfactory density without feathering and with good fixation.

Δ: The print density of characters were somewhat low, or otherwise, feathering was somewhat observed.

×: Upon light rubbing with a finger, the characters have become illegible, or otherwise, writing was difficult.

3. Carriability in Printer 30 sheets prepared by cutting the thermal transfer image-receiving sheet into size A6 were put on top of one another, and black blotted images were continuously printed. This procedure was repeated by 5 sets. That is, printing was carried out on 150 sheets in total. In this case, the carriability of the thermal transfer image-receiving sheet was evaluated in terms of the number of times of incidence of paper feed errors, such as paper jamming. The printer used was P-330 manufactured by Olympus Optical Co., LTD.

○: No paper feed trouble occurred.

×: Paper feed trouble occurred, posing a problem of practical use.

4. Surface Harshness

The level of concaves and convexes of the backside was evaluated by a sensory test with the hand.

○: The backside was free from concaves and convexes, and the quality was felt high.

Δ: Concaves and convexes were somewhat observed, and the level of the texture was felt low.

×: Concaves and convexes were significantly observed, and the texture was deteriorated.

5. Adhesion to Postage Stamp

Tap water was applied to the half of the adhesive surface of a Japanese postage stamp, and the adhesive surface of the sample was applied to the backside of the thermal transfer image-receiving sheet. In this state, the assembly was allowed to stand for 5 hr. Thereafter, the portion, to which the tap water was not applied, was held by the hand to separate the stamp from the image-receiving sheet, and the results were evaluated according to the following criteria.

○: After the separation of the stamp, a part of the stamp remained unremoved on the backside of the thermal transfer image-receiving sheet, and a vestige of the stamp was left.

×: The stamp was simply separated from the backside of the thermal transfer image-receiving sheet, and no vestige of the stamp was left.

6. Environmental Stability

The image-receiving sheet was stored for 7 days under conditions of temperature 60° C. and humidity free in one case and under conditions of temperature of 40° C. and humidity 90% in the other case. Thereafter, printing by means of the above ink jet printers and handwriting were carried out, and the results were evaluated according to the following criteria.

○: There was no feathering, and writing with writing implements was possible.

×: Feathering occurred, or otherwise, writing with writing implements was difficult.

As a result of evaluation by the above methods, in the evaluation by the printing tests using the ink jet printers, for both the ink jet printers, i.e., PM 770 C and BJF 850, any problem with feathering and with ink fixation did not occur, the writing quality was good, the carriability in printers was satisfactory, the surface was free from harshness, the adhesion to a postage stamp was satisfactory, and the environmental stability was satisfactory.

Example B2

A thermal transfer image-receiving sheet of Example B2 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Nylon filler (average particle diameter 7.5 μm) (MW 330, manufactured by Shinto Paint Co., Ltd.) | 100 parts |
| Silicone-modified acrylic resin (manufactured by JSR) | 107 parts |
| Water/isopropyl alcohol = 1/1 | 2000 parts |

The thermal transfer image-receiving sheet thus prepared was evaluated in the same manner as in Example B1. As a result, it was found that, in the evaluation by the printing tests using the ink jet printers, for both the ink jet printers, i.e., PM 770 C and BJF 850, any problem with feathering and with ink fixation did not occur, the writing quality was good, the carriability in printers was satisfactory, the surface was free from harshness, the adhesion to a postage stamp was satisfactory, and the environmental stability was satisfactory.

Example B3

A thermal transfer image-receiving sheet of Example B3 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Nylon filler (average particle diameter 7.5 μm) (MW 330, manufactured by Shinto Paint Co., Ltd.) | 27.75 parts |
| Silicone-modified acrylic resin (manufactured by JSR) | 11 parts |
| Water/isopropyl alcohol = 1/1 | 2000 parts |

The thermal transfer image-receiving sheet thus prepared was evaluated in the same manner as in Example B1. As a result, it was found that, in the evaluation by the printing tests using the ink jet printers, for both the ink jet printers, i.e., PM 770 C and BJF 850, any problem with feathering and with ink fixation did not occur, the writing quality was good, the carriability in printers was satisfactory, the surface was free from harshness, the adhesion to a postage stamp was satisfactory, and the environmental stability was satisfactory.

Example B4

A thermal transfer image-receiving sheet of Example B4 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Nylon filler (average particle diameter 7.5 μm) (MW 330, manufactured by Shinto Paint Co., Ltd.) | 240 parts |
| Silicone-modified acrylic resin (manufactured by JSR) | 20 parts |
| Water/isopropyl alcohol = 1/1 | 2000 parts |

The thermal transfer image-receiving sheet thus prepared was evaluated in the same manner as in Example B1. As a result, it was found that, in the evaluation by the printing tests using the ink jet printers, for both the ink jet printers, i.e., PM 770 C and BJF 850, any problem with feathering and with ink fixation did not occur, the writing quality was good, the carriability in printers was satisfactory, the surface was free from harshness, the adhesion to a postage stamp was satisfactory, and the environmental stability was satisfactory.

Example B5

A thermal transfer image-receiving sheet of Example B5 was prepared in the same manner as in Example B1, except that the composition for a hydrophilic porous layer was changed to the following composition.

| Composition for hydrophilic porous layer | |
|---|---|
| Polyvinyl butyral resin (#3001-1, manufactured by Denki Kagaku Kogyo K. K.) | 100 parts |
| Microsilica (average particle diameter 3.0 μm) (Sylysia 730, manufactured by Fuji Sylysia Chemical Ltd.) | 50 parts |
| Microsilica (average particle diameter 1.4 μm) (Sylysia 310, manufactured by Fuji Sylysia Chemical Ltd.) | 50 parts |
| Water/isopropyl alcohol = 1/1 | 300 parts |

The thermal transfer image-receiving sheet thus prepared was evaluated in the same manner as in Example B1. As a result, it was found that, in the evaluation by the printing tests using the ink jet printers, for both the ink jet printers, i.e., PM 770 C and BJF 850, any problem with feathering and with ink fixation did not occur, the writing quality was good, the carriability in printers was satisfactory, the surface was free from harshness, the adhesion to a postage stamp was satisfactory, and the environmental stability was satisfactory.

Example B6

A thermal transfer image-receiving sheet of Example B6 was prepared in the same manner as in Example B1, except that the composition for a hydrophilic porous layer was changed to the following composition.

| Composition for hydrophilic porous layer | |
|---|---|
| Polyvinyl butyral resin (#3001-1, manufactured by Denki Kagaku Kogyo K. K.) | 100 parts |
| Microsilica (average particle diameter 3.0 μm) (Sylysia 730, manufactured by Fuji Sylysia Chemical Ltd.) | 150 parts |
| Microsilica (average particle diameter 1.4 μm) (Sylysia 310, manufactured by Fuji Sylysia Chemical Ltd.) | 150 parts |
| Water/isopropyl alcohol = 1/1 | 300 parts |

The thermal transfer image-receiving sheet thus prepared was evaluated in the same manner as in Example B1. As a result, it was found that, in the evaluation by the printing tests using the ink jet printers, for both the ink jet printers, i.e., PM 770 C and BJF 850, any problem with feathering and with ink fixation did not occur, the writing quality was good, the carriability in printers was satisfactory, the surface was free from harshness, the adhesion to a postage stamp was satisfactory, and the environmental stability was satisfactory.

Comparative Example B1

A thermal transfer image-receiving sheet of Comparative Example B1 was prepared in the same manner as in Example B1, except that only the hydrophilic porous layer was formed by coating on the backside of the substrate sheet.

The thermal transfer image-receiving sheet of Comparative Example B1 thus prepared was evaluated in the same manner as in Example B1. As a result, in the evaluation by the printing tests using the ink jet printers, for both the ink jet printers, i.e., PM 770 C and BJF 850, significant feathering occurred, and the thermal transfer image-receiving sheet was free from ink fixation, resulting in transfer of ink.

Comparative Example B2

A thermal transfer image-receiving sheet of Comparative Example B2 was prepared in the same manner as in Example B1, except that only the backside coating was formed by coating on the backside of the substrate sheet.

The thermal transfer image-receiving sheet of Comparative Example B2 thus prepared was evaluated in the same manner as in Example B1. As a result, in the evaluation by the printing tests using the ink jet printers, for both the ink jet printers, i.e., PM 770 C and BJF 850, the ink fixation was poor, i.e., a lot of time was required for the fixation, and the quality of writing with the water-base pen and the pencil was poor.

Comparative Example B3

A thermal transfer image-receiving sheet of Comparative Example B3 was prepared in the same manner as in Example B1, except that the composition for a backside coating was changed to the following composition.

| Composition for backside coating | |
|---|---|
| Nylon filler (average particle diameter 7.5 μm) (MW 330, manufactured by Shinto Paint Co., Ltd.) | 100 parts |
| Silicone-modified acrylic resin (manufactured by JSR) | 100 parts |
| Water/isopropyl alcohol = 1/1 | 2000 parts |

The thermal transfer image-receiving sheet of Comparative Example B3 thus prepared was evaluated in the same manner as in Example B1. As a result, in the evaluation by the printing tests using the ink jet printers, for both the ink jet printers, i.e., PM 770 C and BJF 850, the feathering was significant and, in addition, the thermal transfer image-receiving sheet was free from ink fixation, i.e., the transfer of ink was observed. Further, the quality of writing with the water-base pen was poor.

Comparative Example B4

A thermal transfer image-receiving sheet of Comparative Example B4 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Silicone-modified acrylic resin (manufactured by JSR) | 11 parts |
| Water/isopropyl alcohol = 1/1 | 2000 parts |

The thermal transfer image-receiving sheet of Comparative Example B4 thus prepared was evaluated in the same manner as in Example B1. As a result, paper feed trouble occurred, and it was found that the thermal transfer image-receiving sheet of Comparative Example B4 involved a problem of practical use in terms of carriability in printers.

Comparative Example B5

A thermal transfer image-receiving sheet of Comparative Example B5 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Nylon filler (average particle diameter 30 μm) (Orgasol 2002 ES-3, manufactured by Nihon Rilsan K. K.) | 100 parts |
| Silicone-modified acrylic resin (manufactured by JSR) | 11 parts |
| Water/isopropyl alcohol = 1/1 | 2000 parts |

The thermal transfer image-receiving sheet of Comparative Example B5 thus prepared was evaluated in the same manner as in Example B1. As a result, it was found that the thermal transfer image-receiving sheet of Comparative Example B5 had a high level of surface concaves and convexes and, consequently, the texture was poor.

Comparative Example B6

A thermal transfer image-receiving sheet of Comparative Example B6 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Nylon filler (average particle diameter 7.5 μm) (MW 330, manufactured by Shinto Paint Co., Ltd.) | 100 parts |
| Water/isopropyl alcohol = 1/1 | 2000 parts |

The thermal transfer image-receiving sheet of Comparative Example B6 thus prepared was evaluated in the same manner as in Example B1. As a result, in the printing test using the ink jet printers, significant feathering occurred for BJF 850, and feathering somewhat occurred for PM 770 C.

Comparative Example B7

A thermal transfer image-receiving sheet of Comparative Example B7 was prepared in the same manner as in Example B1, except that the composition for a backside coating was changed to the following composition.

| Composition for backside coating | |
|---|---|
| Polyvinyl acetal resin (KX-5, manufactured by Sekisui Chemical Co., Ltd.) | 100 parts |
| Nylon filler (average particle diameter 7.5 μm) (MW 330, manufactured by Shinto Paint Co., Ltd.) | 100 parts |
| Acrylic resin (manufactured by Daicel Chemical Industries, Ltd.) | 11 parts |
| Water/isopropyl alcohol = 1/1 | 2000 parts |

The thermal transfer image-receiving sheet of Comparative Example B7 thus prepared was evaluated in the same manner as in Example B1. As a result, in the printing test using the ink jet printers, feathering somewhat occurred for PM 770 C, and significant feathering occurred for BJF 850.

The results of evaluation for the thermal transfer image-receiving sheets prepared in Examples B1 to B6 and Comparative Examples B1 to B7 are shown in Table B1.

TABLE B1

| | Suitability for ink jetting | | | | Writing quality | | | | Carri- | Adhesion | | |
|---|---|---|---|---|---|---|---|---|---|---|---|---|
| | PM 770 C | | BJF 850 | | Oil- | Water- | | Ball- | ability | Surface | to | Environ- |
| | Feath-ering | Fixation of ink | Feath-ering | Fixation of ink | base pen | base pen | Pen-cil | point pen | in printer | harsh-ness | postage stamp | mental stability |
| Ex. B1 | ○ | ○ | ○ | ○ | ○ | ○ | ○ | ○ | ○ | ○ | ○ | ○ |
| Ex. B2 | ○ | ○ | ○ | ○ | ○ | ○ | ○ | ○ | ○ | ○ | ○ | ○ |
| Ex. B3 | ○ | ○ | ○ | ○ | ○ | ○ | ○ | ○ | ○ | ○ | ○ | ○ |
| Ex. B4 | ○ | ○ | ○ | ○ | ○ | ○ | ○ | ○ | ○ | ○ | ○ | ○ |
| Ex. B5 | ○ | ○ | ○ | ○ | ○ | ○ | ○ | ○ | ○ | ○ | ○ | ○ |
| Ex. B6 | ○ | ○ | ○ | ○ | ○ | ○ | ○ | ○ | ○ | ○ | ○ | ○ |
| Comp. Ex. B1 | X | X | X | X | ○ | ○ | ○ | ○ | ○ | ○ | ○ | — |
| Comp. Ex. B2 | ○ | Δ | ○ | Δ | ○ | Δ | Δ | ○ | ○ | ○ | ○ | — |
| Comp. Ex. B3 | X | X | X | X | Δ | X | Δ | ○ | ○ | ○ | ○ | — |
| Comp. Ex. B4 | ○ | Δ | ○ | Δ | ○ | ○ | X | ○ | X | ○ | ○ | — |
| Comp. Ex. B5 | Δ | ○ | Δ | ○ | Δ | Δ | Δ | ○ | ○ | X | ○ | — |
| Comp. Ex. B6 | Δ | ○ | X | ○ | ○ | ○ | ○ | ○ | ○ | ○ | ○ | — |
| Comp. Ex. B7 | Δ | ○ | X | ○ | ○ | ○ | ○ | ○ | ○ | ○ | ○ | — |

As is apparent from the foregoing detailed description, the thermal transfer image-receiving sheet according to the present invention comprises: a substrate; a dye-receptive layer provided on at least one side of the substrate sheet; a hydrophilic porous layer provided on the substrate sheet in its side remote from the dye-receptive layer, the hydrophilic porous layer being composed mainly of a thermoplastic resin and hydrophilic porous particles; and a backside coating provided on the hydrophilic porous layer, the backside coating comprising a polyvinyl acetal resin, a silicone-modified acrylic resin, and nylon resin particles. By virtue of this constitution, the thermal transfer image-receiving sheet according to the present invention can realize printing with various writing implements and ink jet printers even after storage under high humidity conditions or high temperature and high humidity conditions, not to mention in ordinary environment, has adhesion to postage stamps, and, at the same time, is free from surface harshness and thus has high quality, and can develop stable carriability in printers. Thus, the thermal transfer image-receiving sheet according to the present invention advantageously has very high practical value.

What is claimed is:

1. A thermal transfer image-receiving sheet comprising:

a substrate;

a first recording layer provided on one side of the substrate, the first recording layer being capable of forming an image thereon by a sublimation dye thermal transfer method; and multiple recording layers provided on the other side of the substrate and comprising a combination of two or more layers, said multiple recording layers permitting recording to be made by printing means other than the sublimation dye thermal transfer method, whereby composite recording can be made on both sides of the thermal transfer image-receiving sheet respectively by a plurality of types of image forming means, said multiple recording layers comprising an absorption layer and a fixation layer provided in that order on the substrate, the fixation layer comprising a polyvinyl acetal resin and a nylon filler.

2. The thermal transfer image-receiving sheet according to claim 1, wherein the nylon filler comprises spherical particles having an average particle diameter of 5 to 20 $\mu$m.

3. The thermal transfer image-receiving sheet according to claim 1, wherein the weight ratio of the nylon filler to the polyvinyl acetal resin in the fixation layer is 0.25 to 2.0.

4. The thermal transfer image-receiving sheet according to claim 1, wherein the fixation layer further comprises a surfactant.

5. The thermal transfer image-receiving sheet according to claim 1, wherein the absorption layer in the multiple recording layers comprises a polyvinyl butyral resin and a filler.

6. The thermal transfer image-receiving sheet according to claim 1, wherein the multiple recording layers constitute an ink jet recording layer.

7. The thermal transfer image-receiving sheet according to claim 1, wherein the multiple recording layers constitute either a recording layer for thermal ink transfer or a recording layer for electrophotography.

8. A thermal transfer image-receiving sheet comprising:

a substrate sheet;

a dye-receptive layer provided on at least one side of the substrate sheet;

a hydrophilic porous layer provided on a side of the substrate sheet opposite to the dye-receptive layer side, said hydrophilic porous layer being composed mainly of a thermoplastic resin and hydrophilic porous particles; and a backside coating provided on the surface of the hydrophilic porous layer, said backside coating comprising a polyvinyl acetal resin, a silicone-modified acrylic resin, and nylon resin particles.

9. The thermal transfer image-receiving sheet according to claim 8, wherein the content of the silicone-modified acrylic resin is 5 to 35% by weight based on the total solid content of the backside coating.

10. The thermal transfer image-receiving sheet according to claim 8, wherein the nylon resin particles have an average particle diameter of 5 to 20 $\mu$m and the weight ratio of the nylon resin particles to the resin in the backside coating is 0.25 to 2.0.

11. The thermal transfer image-receiving sheet according to claim 8, wherein the thermoplastic resin in the hyrophilic porous layer is a polyvinyl butyral resin or a polyvinyl acetal resin.

* * * * *